United States Patent [19]

Spengler

[11] 4,014,234

[45] Mar. 29, 1977

[54] CUTTING APPARATUS

[75] Inventor: Ernst M. Spengler, Heusenstamm, Germany

[73] Assignee: Stanztechnik GmbH Roeder & Spengler, Bergen-Enkheim, Germany

[22] Filed: Nov. 13, 1974

[21] Appl. No.: 523,546

Related U.S. Application Data

[63] Continuation-in-part of Ser. No. 338,342, March 5, 1973, Pat. No. 3,859,879.

[30] Foreign Application Priority Data

Mar. 8, 1972 Germany ..... 2211118
Nov. 20, 1973 Germany ..... 2357820

[52] U.S. Cl. ..... 83/162; 83/296; 83/302; 83/342; 83/347; 83/446; 83/659; 83/699

[51] Int. Cl.[2] ..... B26D 1/36; B26D 1/40

[58] Field of Search ..... 83/285, 296, 347, 346, 83/342, 674, 672, 659, 673, 422, 699, 302, 446, 162

[56] References Cited

UNITED STATES PATENTS

| | | | |
|---|---|---|---|
| 1,283,342 | 10/1918 | Smith | 83/296 |
| 2,034,161 | 3/1936 | Thiel | 83/674 |
| 2,180,204 | 11/1939 | Hallden | 83/674 |
| 2,310,851 | 2/1943 | Haren et al. | 83/296 |
| 2,548,427 | 4/1951 | Fernbach | 83/296 |
| 2,776,679 | 1/1957 | King | 83/422 |
| 3,056,323 | 10/1962 | Kwitek | 83/342 |
| 3,274,873 | 9/1966 | Sauer | 83/347 |
| 3,499,355 | 3/1970 | Watt et al. | 83/422 |
| 3,511,122 | 5/1970 | Sherrill et al. | 83/422 X |
| 3,570,348 | 3/1971 | Hallden | 83/342 |
| 3,823,633 | 7/1974 | Ross | 83/659 X |
| 3,857,314 | 12/1974 | Gregoire | 83/674 X |

*Primary Examiner*—Frank T. Yost
*Attorney, Agent, or Firm*—W. G. Fasse; W. W. Roberts

[57] ABSTRACT

This cutting apparatus includes a frame structure supporting a cutting roller and a counter pressure roller arranged at an angle relative to the feed advance direction of sheet material to be cut. Drive means are provided for the cutting roller and for the counter pressure roller in the form of a common drive chain positively interconnecting the rollers with a drive motor through an instantaneously operable clutch, such as an electromagnetic or pneumatic clutch. A brake is provided between the cutting roller and the frame structure, whereby the control of the clutch and of the brake is such that engagement of the positive drive through the clutch disengages the brake and vice-versa.

25 Claims, 10 Drawing Figures

28
29
30
31
33
25
41'
38
46
41
36
35
34
44
34
47
39
27
40'
40'
37
42
26
40
43
41''
41
32
31
45

93
81
85
82
79
78
75
80
77
76
107
84
94
83

CUTTING APPARATUS

BACKGROUND OF THE INVENTION

The present invention is a continuation-in-part application of my copending Ser. No. 338,342 filed Mar. 5, 1973, now U.S. Pat. No. 3,859,879 issued Jan. 14, 1975.

The present invention relates to cutting apparatus, especially for cutting sheet material primarily along lines extending across the feed advance direction of the sheet material, but also along lines extending at an angle relative to the feed advance direction and along lines extending in parallel to the feed advance direction.

My above mentioned copending application discloses a cutting apparatus, wherein a cutting roller and a counter pressure roller are supported in a frame structure at an angle relative to the feed advance direction of the sheet material to be cut. The cutting roller is provided with strip steel or so called steel rule knives extending along a helix on the surface of the cutting roller, which may be a hollow cylinder. The slanting angle relative to a line extending perpendicularly to the feed advance direction is selected so that the slant resulting from the helical arrangement of the cutting knives is compensated. In other words, the cut will extend along a line extending perpendicularly to the feed advance direction of the sheet material in spite of the fact that the cutting roller and the counter pressure roller extend at an angle relative to said direction. U.S. Pat. No. 3,552,251 granted on Jan. 5, 1971 discloses a similar cutting apparatus for perforating sheet material along lines extending perpendicularly to the longitudinal extension of the sheet material. This reference discloses several rollers including a cutting roller with slanted knives, whereby the rollers are driven in unison and wherein drive control means are provided including gear means, as well as a register for feeding a corrective motion into the shaft carrying the cutting roller. The corrective motion is determined by a motor, which in turn is responsive to a comparing circuit, which compares signals derived from an electric eye scanner the advancing web or sheet material and derived from the rotation of the cutting roller shaft. An instantaneous stopping and driving of the cutting roller for precisely defined durations is apparently not intended in said U.S. Patent.

OBJECTS OF THE INVENTION

In view of the foregoing, it is the aim of the invention to achieve the following objects singly or in combination:

to provide a cutting apparatus of the above described type in which a positive drive between the cutting roller and the counter pressure roller assures a synchronized rotation of the two rollers, without any slippage therebetween;

to provide clutch and brake means for the rollers, preferably for the cutting roller, which may be signal controlled for an instantaneous starting and stopping of the rollers, and for driving these rollers for a predetermined length of time;

to provide a drive mechanism which will continuously advance the sheet material to be cut and which will intermittently drive the cutting roller, whereby the length of the cut pieces may be controlled by varying the duration of the drive of the cutting rollers;

to provide means for varying the angular position of the rollers, especially the cutting roller relative to the feed advance direction, whereby it would be possible to cut pieces along lines which extend at an angle relative to the feed advance direction deviating from 90°;

to provide further cutting means for cutting the sheet material along lines extending in parallel to the feed advance direction which in combination with the cross cutting means will enable the cutting of varying shapes, for example, shapes with cut out corners, trapezoids, and the like;

to provide positive guide means just ahead, that is upstream of the cutting roller near the point of cutting and just downstream of the point of cutting, as viewed in the feed advance direction; and to provide means for adjustably securing the strip steel knives to the cutting roller or cylinder, whereby the position of the strip steel knives may be varied or adjusted.

SUMMARY OF THE INVENTION

The above objects have been achieved according to the invention in an apparatus of the above type by providing between the drive means and the cutting roller an instantaneously operating clutch, which is signal responsive and thus capable of remote control, such as an electromagnetic or pneumatic clutch, and by further providing between the cutting roller and the frame structure an instantaneously operable brake, preferably also suitable for remote control and for coordinated cooperation with the clutch.

According to the invention, the cutting roller is rotated only when a cut is to be performed. On the other hand, the counter pressure roller is continuously driven to continuously feed or advance the sheet material to be cut in a given direction. This type of operation is possible, because the strip steel knives attached to the cutting roller do not extend all around the entire circumference of the cutting roller, so that portions of the circumference of the cutting roller are not provided with any cutting knives.

Further, according to the invention, the length of the cut pieces may be varied by controlling the clutch and the brake so that the cutting roller is positively driven for predetermined durations. This has the advantage that different lengths of cut material may be produced without exchanging the cutting roller.

According to the invention there is further provided a journal shaft to which a cutting roller is tiltably secured in such a manner that the cutting roller may be tilted or journaled about the journal shaft, preferably by means of a tilting drive, such as a piston cylinder arrangement, whereby the cutting roller may be adjusted onto a different operating position after each cutting operation.

BRIEF FIGURE DESCRIPTION

In order that the invention may be clearly understood, it will now be described, by way of example, with reference to the accompanying drawings, wherein.

Figure 6:
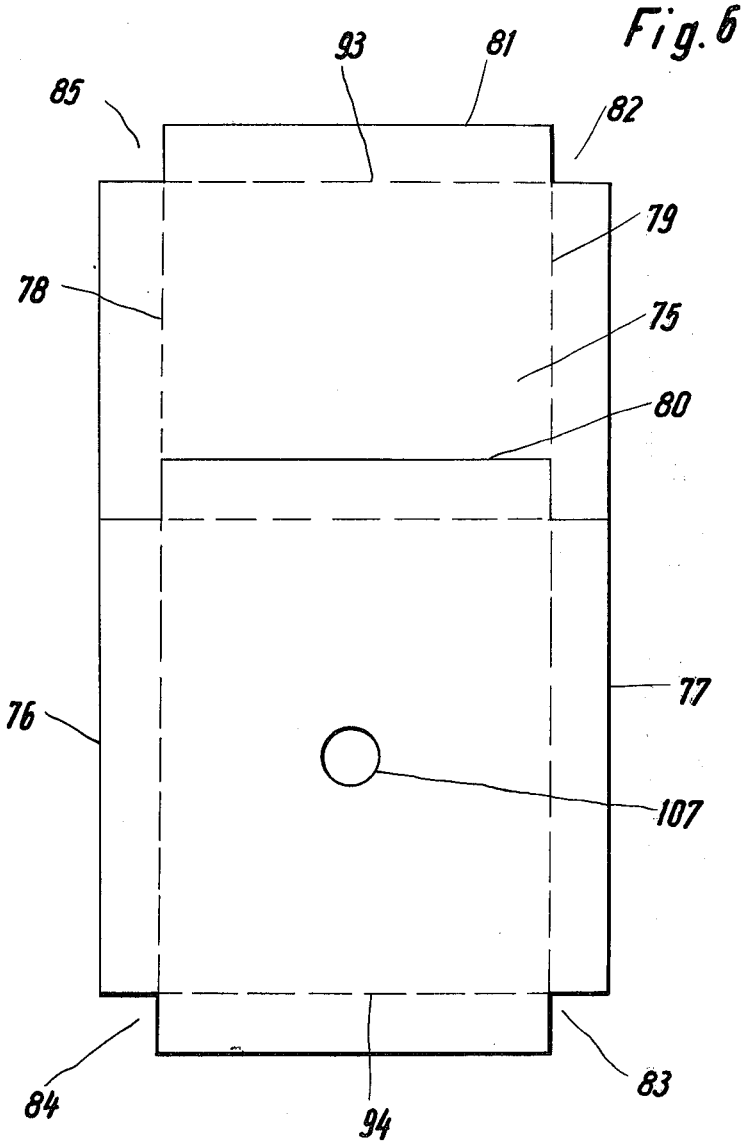
FIG. 6 is a plan view onto a workpiece, the shape of which may be cut by means of the present apparatus.
Figure 7:
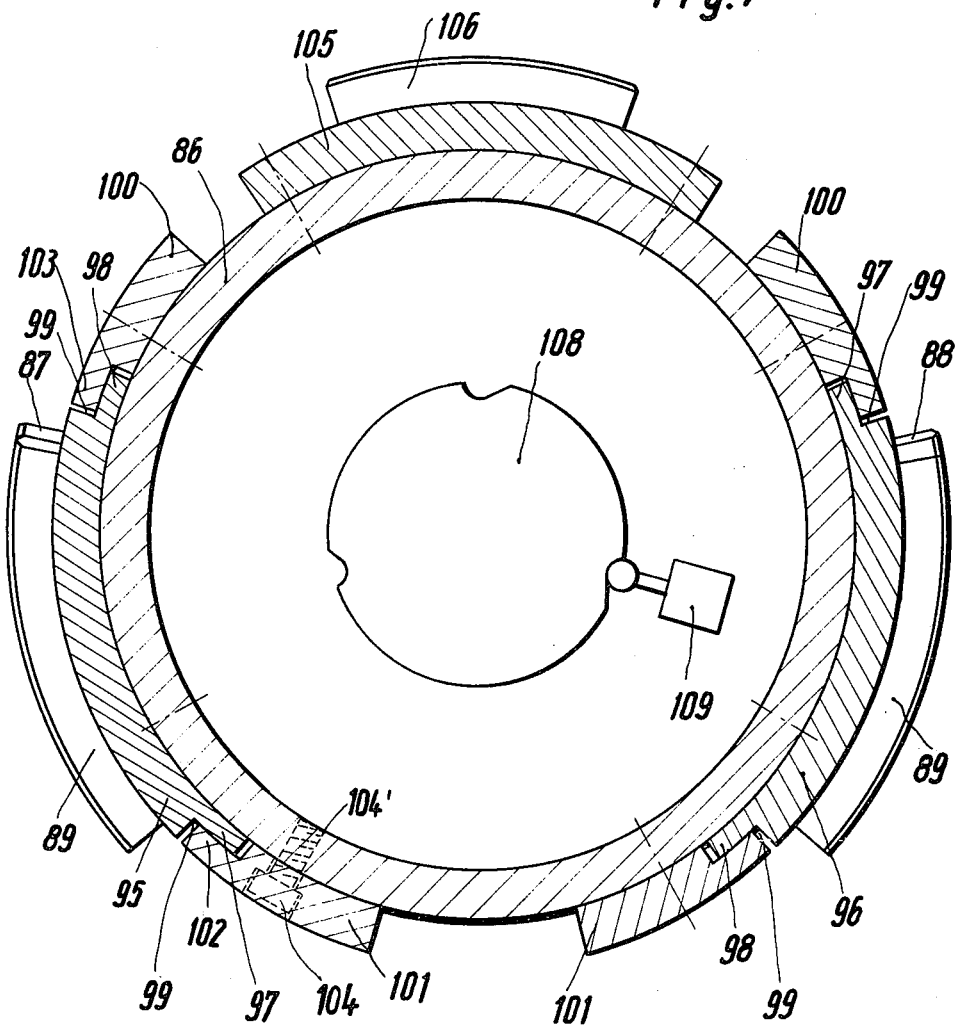
Figure 8:
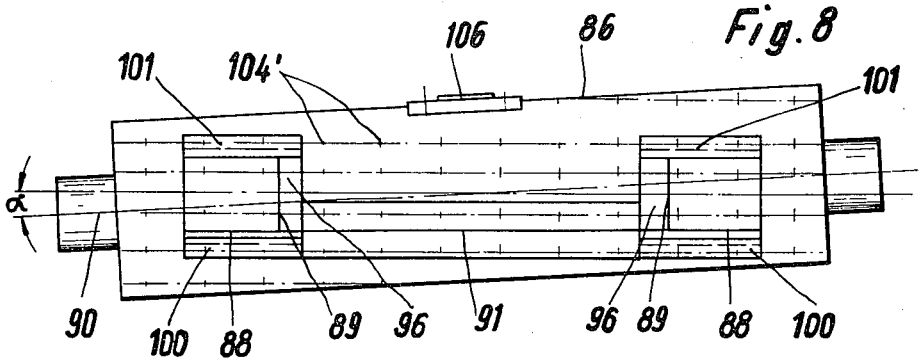
Figure 9:
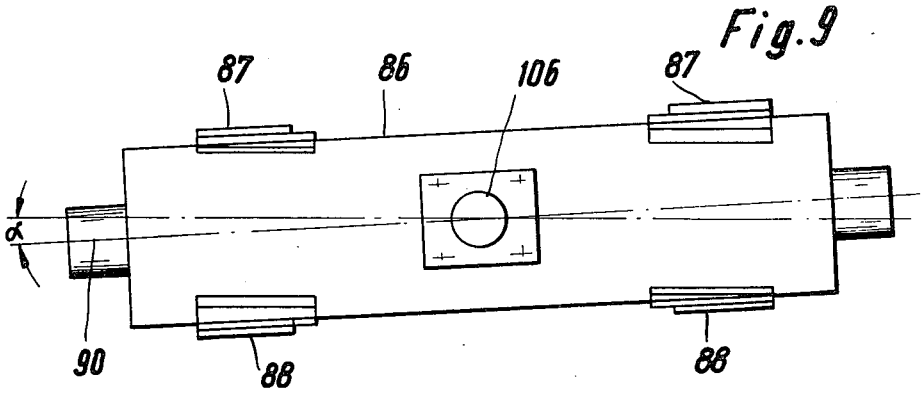
Figure 10:
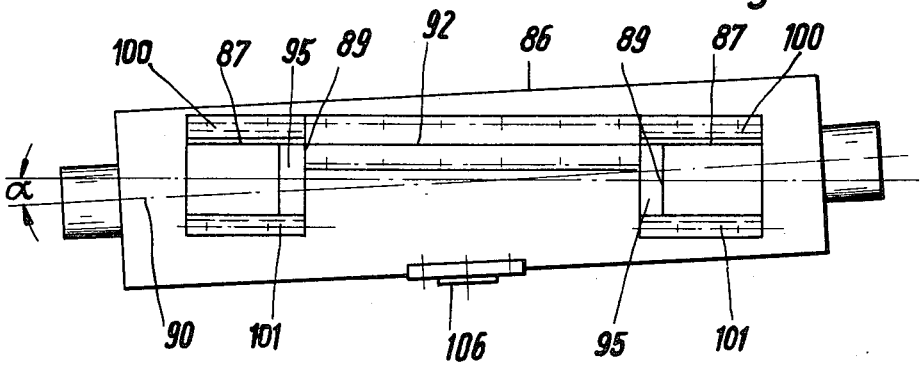

FIG. 7 is a enlarged sectional view through a modified embodiment of a cutting roller according to the invention, whereby the means for securing the cutting knives to the cutting roller cylinder permit a positional adjustment of the cutting knives relative to the length of the cutting roller; and FIGS. 8 9 and 10 illustrate top views or plan views of various rotational positions of the cutting roller according to FIG. 7 and provided with a knive means for cutting a workpiece having the shape illustrated in FIG. 6.

DETAILED DESCRIPTION OF EXAMPLE EMBODIMENTS

Figure 1:
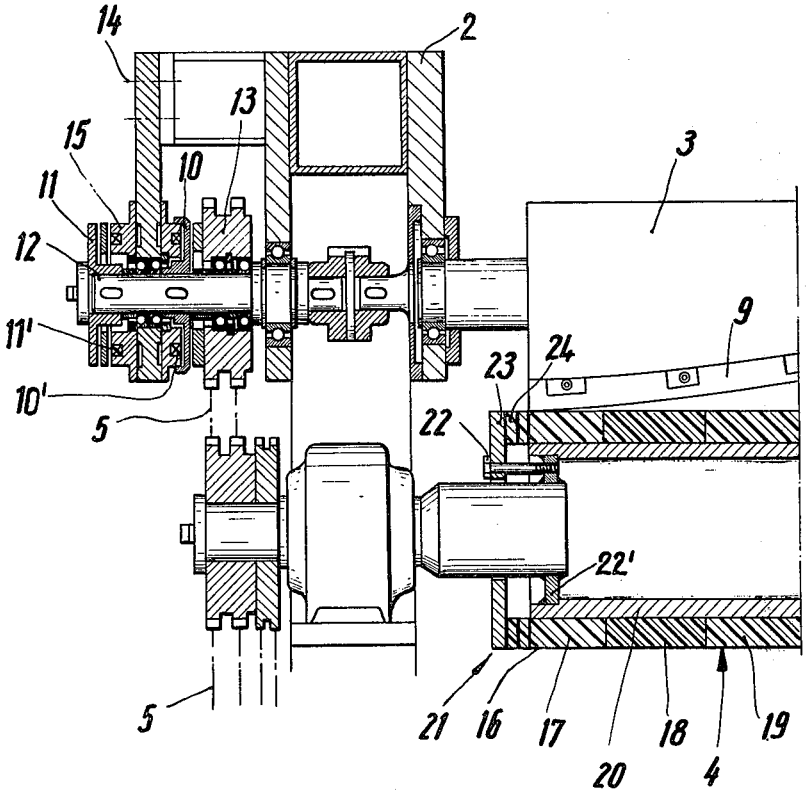
FIG. 1 illustrates a substantially vertical section through a portion of the present apparatus, whereby parts not essential for the understanding of the present invention have been omitted.
Figure 2:
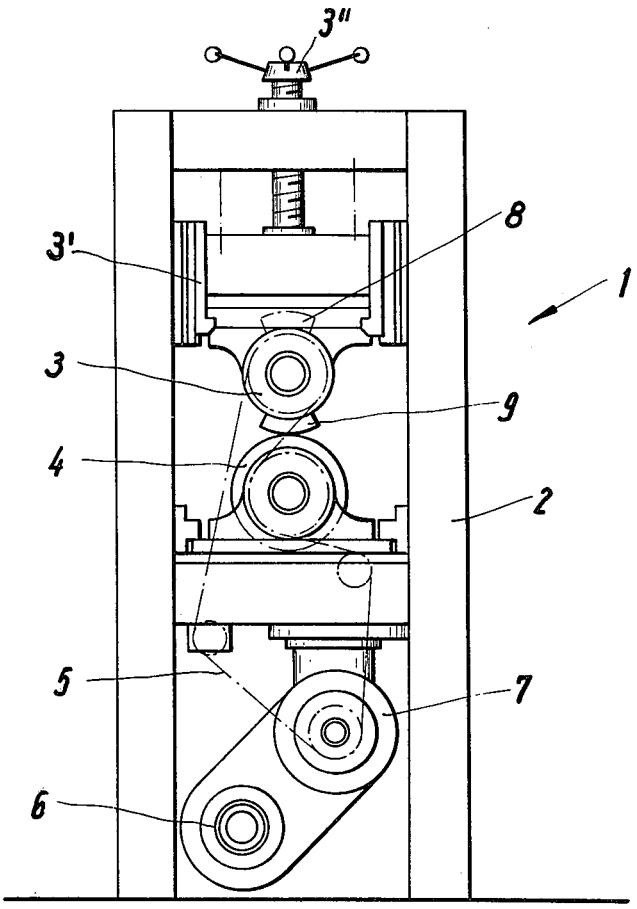
FIG. 2 is a somewhat simplified side view of an apparatus according to the invention.

Referring first to FIGS. 1 and 2 the present cutting apparatus comprises a frame structure 2 only parts of which are shown in FIG. 1. A cutting roller 3 is supported in the frame structure by means of a carriage 3', the elevational position of which is adjustable up and down by means of a screw drive 3''. A counter pressure roller 4 is also supported in the frame structure on a support table and preferably in a removable manner. A chain drive 5 is provided in common for the cutting roller 3 and for the counter pressure roller 4 to positively drive these two rollers in synchronism with each other by means of a motor 6 through a gear drive 7.

The cutting roller 3 is provided with knives 8 and 9 in a conventional manner. According to the invention, a clutch 10, preferably an electro-magnetic clutch is arranged between the drive shaft 12 of the cutting roller 3 and the sprocket wheel 13 of the chain drive 5. The electro-magnetic clutch 10 includes a solenoid coil 10' by means of which the chain drive may be positively and instantaneously transmitted onto the drive shaft 12 or the positive drive may be interrupted instantaneously. The sprocket wheel 13 runs freely on the shaft 12, for example, on ball bearings. A friction member is inserted between the sprocket wheel 13 and the movable member of the clutch 10, which movable member in turn is secured against rotation on the drive shaft 12, for example, by tongue and groove means permitting an axial sliding toward and away from the friction member of the sprocket wheel 13. A brake mechanism 11 similar in construction to that of the clutch 10 is arranged according to the invention between a support plate 14 forming part of the frame structure 2 and the drive shaft 12. The brake 11 also includes a solenoid coil 11' and a friction member inserted between the stationary portion of the brake 11 and a flange secured against rotation on the drive shaft 12, but axially movable in response to the energization of the solenoid 11'. The control of the clutch 10 and the brake 11 is such that the brake is released when the clutch is energized, and vice-versa. In its simplest embodiment such control may be accomplished, for example, by a single pole, double throw switch which in one position energizes the clutch while simultaneously interrupting the circuit for the brake and vice-versa.

As mentioned, the sprocket wheel 13 is freely rotatable on the drive shaft 12 of the cutting roller 3, when the clutch 10 is disengaged. The brake 11 includes a member secured to the frame support block or plate 14 which carries a solenoid coil 11' cooperating through friction means with the brake flange secured to the shaft 12. From the description of the clutch 10 and brake 11, it is apparent that both operate in the same manner, electro-magnetically in the shown example. However, the brake and the clutch may also be of the pneumatic or hydraulic type or a switch operating the energizing circuit for the brake and the clutch may be operated pneumatically.

FIG. 1 also illustrates the construction of the counter pressure roller 4 as including an inner cylinder 20, for example of metal, such as steel. A plurality of sleeves 17, 18, and 19 surround the inner cylinder 20 to form a cutting surface 16. The sleeves 17, 18 and 19 are made, for example, of synthetic material such as nylon or the like. These sleeves are spaced from each other by spacer rings 24, having different widths so that by exchanging the spacer rings 24 it is possible to axially shift the location or position of the sleeves 17, 18 and 19 in order to bring different surface portions of these sleeves into the cutting position and thus more efficiently use the entire surface of these sleeves. The sleeves are held in position on the cylinder 20 by means of a plate 23 closing the end 21 of the counter pressure roller 4. The plate 23 in turn is held in position by screw bolts 22 extending into an end flange 22' for example, welded to the inner cylinder 20.

As mentioned, by varying the number of spacer rings 24, or by employing spacer rings of different widths, it is possible to shift the surface of the sleeves 17, 18 and 19 so that used up surface portions are shifted out of the cutting position and new smooth surface portions can be shifted into the cutting position. This has the advantage that the sleeves may be used more efficiently and that clean cuts are assured at all times.

Figure 3:
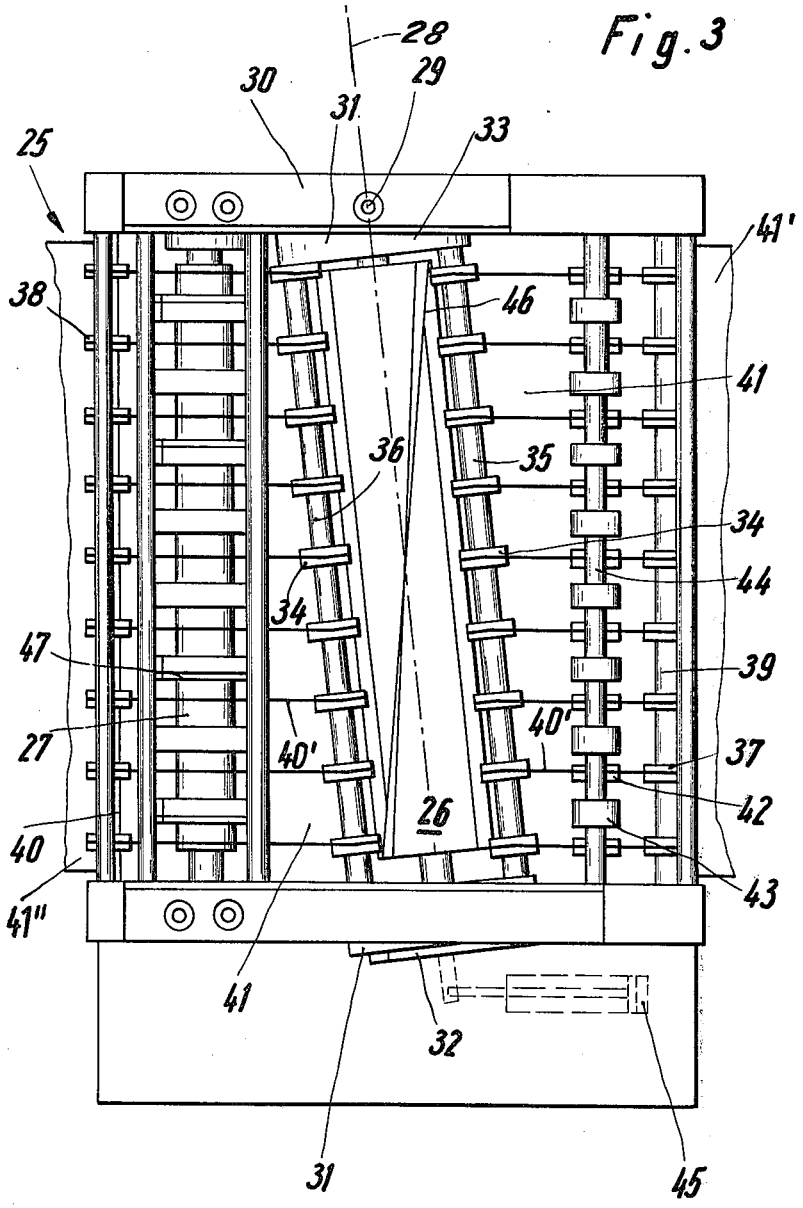
FIG. 3 illustrates a plan view or top view onto a modified embodiment of the present invention, wherein positive guide means are provided upstream and downstream of the cutting roller in such a manner that the sheet material is guided almost up to the cutting point and also immediately after the cutting point or downstream of the cutting point.

The top view illustrated in FIG. 3 shows a modified cutting apparatus 25, comprising a cross cutting roller 26 as well as further cutting means 27 for cutting the sheet material into longitudinal strips, whereby the cutting line extends in parallel to the feed advance direction of the sheet material. The further cutting means 27 may, for example, comprise a plurality of disk cutters 47 arranged on a common shaft and spaced from each other by appropriate spacer elements.

The cross cutting roller 26 is supported in frame means 31 having end pieces 32 and 33 interconnected by rods 35 and 36. The end piece 31 is journaled to a journal axis 29 secured in the frame structure. The end piece 32 is movable in a horizontal plane within guide means of the frame structure and may be adjusted by drive means, for example, a piston cylinder arrangement 45, which thus enables the shifting of the rotational axis 28 of the cutting roller 26 about the journal axis 29.

The frame rods 35 and 36 support guide rollers 34. Thus these guide rollers 34 which are preferably evenly distributed along the length of the cutting roller 26 provide guide means for the sheet material upstream and downstream of the cutting roller and as close as possible to the cutting location.

Further guide rollers 37 and 38 are arranged on respective support rods 39 and 40 which are directly supported in the frame structure 30. Each pair of guide rollers 34 and 37, as well as 34 and 38 supports an endless flexible guide element, for example, in the form of endless rubber cords 40'. If desired, further conveyor belt means may be provided for the workpiece, such as the downstream conveyor belt 41' and the upstream conveyor belt 41'' assuming that the feed advance direction is from left to right in FIG. 3. The rubber cords 40' bridge the free space 41 between the cutting roller 26 proper and the respective conveyor belts 41', 41''. Since this free space 41 has a wedge shape, it will be appreciated that the rubber cords 40' will have different lengths. Further, since the rubber cords 40' are sufficiently flexible and elastic, they permit the positional adjustment of the cutting roller 26 by the drive means 45, as described above.

In addition to the just described guide means comprising the rubber cords 40' there are provided support rollers 42 and guide rollers 43 carried on respective rods 44 supported in the frame structure.

Due to the angular adjustment of the position of the cutting roller 26 it is possible to vary the cutting position after each cutting step. This has the advantage that workpieces may be cut from the sheet material having a predetermined shape, for example, a trapezoidal shape. The parallel sides of the trapezoid are cut by means of the longitudinal cutters 27 including the cutting disks 47, whereas the non-parallel sides of the trapezoid are cut by the cutting roller 26. Instead of adjusting the position of the cutting roller 26 by a piston cylinder arrangement 45 it would also be possible to employ, for example, a chain drive and respective gear means or the like, such as tooth and rack means.

FIG. 3 also illustrates that the cutting knife or strip steel knife 46 extends along a helical line on the surface of the cutting roller 26, whereas the cutting knives 47 extend circumferentially relative to the roller 27.

The clutch 10 and brake 11 described specifically with reference to FIG. 1 may also be employed in the embodiment of FIG. 3. The control of the clutch and the brake, as well as of the drive means 45 for the angular position adjustment of the cutting roller 26 may be accomplished preferably by means of digital control devices carrying out a programmed sequence of steps, whereby the program may be stored on punched tapes, cards, or the like. Further, the particular type of control of the operation of the apparatus especially of the clutch ad brake means will depend on the particular type of cutting to be performed and the control as such is not part of the present invention.

Figure 4:
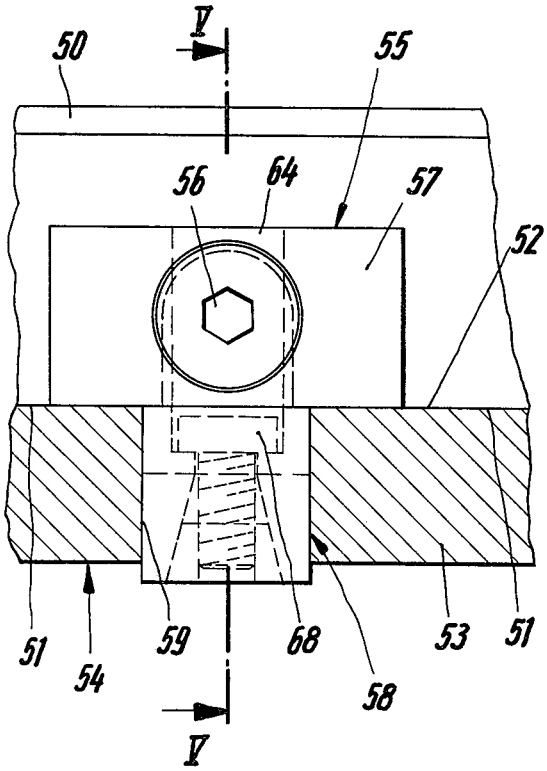
FIG. 4 shows partially in section one embodiment of means for securing the strip steel knives to the cutting roller cylinder, whereby the illustration is on a somewhat enlarged scale as compared to the other figures.
Figure 5:
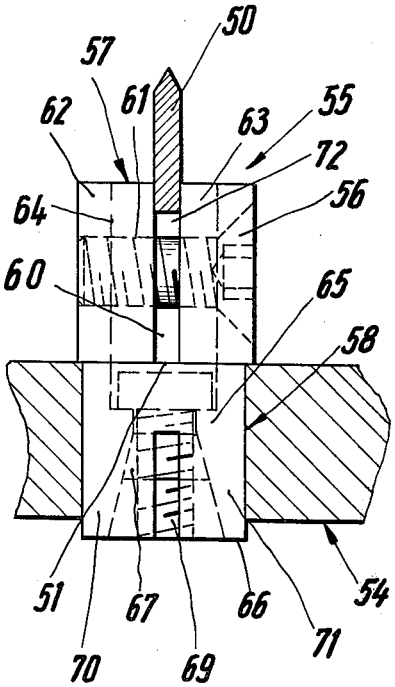
FIG. 5 is a sectional view along the line V—V in FIG. 4.

FIGS. 4 and 5 illustrate means for securing a strip steel knife 50 to the surface 52 of the cylinder 53 of a cutting roller 54 so that the knife 50 extends radially away from the surface 52. The knife 50 has a flat back which rests on the surface 52. According to the invention the means for connecting the knives to the cylinder comprise holding blocks 55 which may have a T-configuration as best seen in FIG. 4. A cross member 57 and a support member 58 form the T-configuration. The cylinder 53 is provided with holes 59 which receive the support members 58. A screw 56 secures the knife 50 to the cross member 57 and a further screw 68 secures the support member 58 to the cylinder 53. To this end the cross member 57 comprises a gap 60 extending entirely through the cross member 57. The gap is deep enough so that the knife 50 may rest on the surface 52 of the cylinder 53. The cross member further comprises a horizontally extending bore 61 at least one portion of which is threaded to receive the fastening screw 56 when the knife 50 is received in the gap 60. Preferably, the knife 50 is provided with an aperture 72 registering with the bore 61 so that the screw 56 may extend through the knife 50 to clamp the two portions 62, 63 of the cross member 57 against the sides of the knife 50. However, it is also possible to extend the cross bore 61 only through one of the portions 62 or 63 so that the inner end of the screw 56 will bear against the side of the knife. In that instance the knife need not be provided with apertures 72.

A further bore 64 extends vertically through the cross member 57 of the holding block 55 and down into the support portion 58. A further conical hole 67 extends in axial alignment with the first mentioned hole through the support member 58, whereby the smaller diameter end of the further hole 67 merges into the first mentioned hole to form a shoulder 65. A screw 68 rests with its head on the shoulder 65 and its threaded end is received in a wedging body 69 whereby the outer lower edge of the support member 58 is pressed against the surface of the holes 59. To facilitate this wedging action, the support member may be slotted at its outer end or the support member 58 may comprise two legs 70, 71 whereby the wedging body 69 is forced into the conical hole between the two legs 70 and 71 so as to press these legs against the walls of the holes 59, whereby the knife support means 55 are removably but securely held in the surface of the cutting roller cylinder 53.

FIG. 6 illustrates a workpiece or blank 75 for a folding box. The longitudinally extending edges 76 and 77 are cut by the disk cutters 47 as mentioned above. Similarly, the dashed crease lines 78 and 79 are also produced by the cutting means 27.

The shorter sides are cut by the cutting roller 26 and the length of the workpiece or blank will be determined by the speed of the feed advance of the sheet material as well as by the arrangement of the knives on the drum and the rotation of the cutting roller. Thus, the size of the finished blank may be determined by the control of the clutch and brake elements as described above. For example, if a smaller blank is to be cut, as indicated by the thinner line 80, the control of the brake and clutch will be adjusted accordingly, while moving the sheet material with a constant speed in the feed advance direction.

The cut out corners 82, 83, 84 and 85 of the blank 75 are cut by means of a cutting roller 86 illustrated in FIGS. 8 to 10. This roller 86 carries on its surface strip steel knives 87 and 88 arranged along a helical line extending substantially in the longitudinal direction of the cutting roller 86. Further knives 89 also extending along a helical line are secured to the surface of the cutting roller 86. However, the further knives 89 extend in the circumferential direction of the roller 86. FIGS. 8, 9, and 10 show the angle $\alpha$ by which the longitudinal rotational axis 90 of the roller 86 deviates from 90° relative to the feed advance direction.

The knives 88 and 89 as shown in FIG. 8 cut the corners 83 and 84 of the blank 75. The knives 87 and 88 as shown in FIG. 10 cut the corners 82 and 85 of the workpiece. The knives 91 and 92 cut the crease lines 93 and 94 respectively.

For securing the knives 87 to 92 on the surface of the cutting roller 86, there are provided curved support elements 95 and 96 as best seen in FIG. 7. The support members 95 and 96 have marginal edges 97 and 98 to form a shoulder 99, which is overlapped by a clamping member 100, 101 for holding down and guiding the support members 95 and 96 by a clamping connection between a protruding edge 102, 103 and the edge 97, 98. The clamping force is provided by screws 104 extending through threaded bores 104' in the cylinder of the clamping roller 86. As best seen in FIG. 8, the holes 104' for receiving the screws 104 extend along helical lines along the surface of the cutting roller 86, whereby the position of the cutting knives may be easily adjusted along the length of the cutting roller 86 and along said spiral lines. This feature has the advantage that the cutting knives may be placed in any desired position on the surface of the cutting roller 86.

FIG. 7 further illustrates carrier members 105 for a circular cutting knife 106, also secured by means of screws to the surface of the cutting roller 86. The knife 106 produces the hole 107 in the blank 75 as seen in FIG. 6. The knife 106 is also shown in its several positions in FIGS. 8 to 10 as the cutting roller 86 rotates. The just described direct connection of the cutting knife 106 on the support 105, which in turn is directly screwed to the cylinder 86, as shown in FIG. 7 is especially suitable where the position of the knife 106 does not have to be adjusted repeatedly in the course of a normal cutting operation. On the other hand the securing of the knives 88, 89 as also shown in FIG. 7 is advantageous where the position of the knives requires repeated adjustment because only one or a few screws need to be loosened and retightened to restore the clamping action.

FIG. 7 further illustrates a cam member 108 as part of the cutting roller 86, which rotates along with the cutting roller 86 and which cooperates with switch means 109 for example, a single pole double throw switch arrangement for controlling the operation of the clutch 10 and the brake 11.

Although the invention has been described with reference to specific embodiments, it is to be understood, that it is intended to cover all modifications and equivalents within the scope of the appended claims.

What is claimed is:

1. In an apparatus for cutting sheet material advancing in a given direction, including a frame structure, a cutting roller for cutting the sheet material substantially across said advancing direction and a counter pressure roller, each roller having a rotational axis and an outer surface, means rotatably supporting both of said rollers in said frame structure for cooperation with each other, strip steel knife means, means securing said strip steel knife means to said cutting roller, whereby said strip steel knife means extend substantially radially away from said cutting roller, said strip steel knife means following a helix around the cutting roller which extends with its longitudinal axis at an angle ($\alpha$) relative to a line extending perpendicularly to said given direction, said angle ($\alpha$) compensating for the fact that the strip steel knife means follow a helix, the improvement wherein, said securing means comprise a plurality of individual holding blocks releasably secured in holes in the outer surface of said cutting roller, and means releasably holding said strip steel knife means in each of said holding blocks, in which holes said holding blocks are rotatable in their released condition for adjusting the knife position, each hole having a radially extending axis which extends in the plane of said strip steel knife means when the latter are secured to the cutting roller, said apparatus further comprising journal means having a journal axis held in said frame structure, said cutting roller having frame means secured to said journal means for tilting said cutting roller about said journal axis extending substantially perpendicularly to the rotational axis of said cutting roller.

2. The apparatus according to claim 1, further comprising drive means for said rollers, clutch means, and brake means, said clutch means being operatively interposed between the drive means and the cutting roller, and wherein the brake means is operatively interposed between the cutting roller and the frame structure, said apparatus further comprising means operatively connected to said clutch means and to said brake means for controlling the operation thereof.

3. The apparatus according to claim 2, wherein said control means for said clutch means and for said brake means coordinate the operation of the clutch means and of the brake means to each other, so that the clutch means is effective when the brake means is released and vice-versa.

4. The apparatus according to claim 1, wherein said clutch means and said brake means each comprise respective solenoid means for an instantaneous operation.

5. In the apparatus of claim 1, the further improvement wherein said counter pressure roller comprises a plurality of axially displaceable rings forming the outer surface of the counter pressure roller, and means for holding said rings in fixed positions along the length of said counter release roller.

6. The apparatus according to claim 1, further comprising support means for supporting said sheet material upstream and downstream of said cutting roller as viewed in the material advance direction, said support means comprising first banks of first guide roller means held in said frame structure upstream of said cutting roller, second banks of second guide roller means held in said frame structure downstream of said cutting roller, and longitudinal, flexible guide means running over said guide roller banks.

7. The apparatus according to claim 6, wherein said longitudinal, flexible guide means comprises a plurality of endless rubber cords, running over said guide roller means.

8. The apparatus according to claim 1, comprising further cutting means supported in said frame structure for cutting said sheet material longitudinally in said advance direction.

9. The apparatus according to claim 1, wherein said holding blocks include wedging means which wedge the holding blocks into said holes.

10. The apparatus according to claim 2, further comprising cam means secured to said cutting roller, and cam responsive switching means arranged for actuation by said cam means to control said clutch means and said brake means in response to the rotation of said cutting roller.

11. In an apparatus for cutting sheet material advancing in a given direction, including a frame structure, a cutting roller for cutting the sheet material substantially across said advancing direction and a counter pressure roller, each roller having a rotational axis an an outer surface, means rotatably supporting both of said rollers in said frame structure for cooperation with each other, strip steel knife means, means securing said strip steel knife means to said cutting roller, whereby said strip steel knife means extend substantially radially away from said cutting roller, said strip steel knife means following a helix around the cutting roller which extends with its longitudinal axis at an angle ($\alpha$) relative to a line extending perpendicularly to said given direction, said angle ($\alpha$) compensating for the fact that the strip steel knife means follow a helix, the improvement comprising drive means for said rollers, clutch means operatively interposed between said drive means and at least one of said rollers, and brake means operatively interposed between at least one of said rollers and said frame structure, and further comprising journal means having a journal axis held in said frame structure, said cutting roller having frame means secured to said journal means for tilting said cutting roller about said journal axis extending substantially perpendicularly to the rotational axis of said cutting roller.

12. The apparatus according to claim 11, wherein said frame means comprises two end pieces and longitudinal rods extending in parallel to said cutting roller and interconnecting said end pieces, said apparatus further comprising support means for supporting said sheet material upstream and downstream of said cutting roller as viewed in the material advance direction, said support means comprising first banks of first guide roller means held in said frame structure upstream of said cutting roller, second banks of second guide roller means held in said frame structure downstream of said cutting roller, and longitudinal guide means running over said guide rollers, one of said longitudinal rods being arranged upstream of the cutting roller between the latter and said first banks of guide roller means, the other of said longitudinal rods being arranged downstream of the cutting roller between the latter and said second banks of guide roller means, said apparatus further comprising support roller means rotatably supported intermediate said second banks, and further guide roller means also rotatably supported intermediate said second banks, said support and further guide roller means supporting and guiding said longitudinal guide means intermediate said second banks.

13. The apparatus according to claim 11, wherein said tilting means comprise drive means arranged between the frame structure and the frame means of the cutting roller for tilting the cutting roller about an axis extending substantially perpendicularly to the rotational axis of said cutting roller.

14. In an apparatus for cutting sheet material advancing in a given direction, including a frame structure, a cutting roller for cutting the sheet material substantially across said advancing direction and a counter pressure roller, each roller having a rotational axis and an outer surface, means rotatably supporting both of said rollers in said frame structure for cooperation with each other, strip steel knife means, means securing said strip steel knife means to said cutting roller, whereby said strip steel knife means extend substantially radially away from said cutting roller, said strip steel knife means following a helix around the cutting roller which extends with its longitudinal axis at an angle ($\alpha$) relative to a line extending perpendicularly to said given direction, said angle ($\alpha$) compensating for the fact that the strip steel knife means follow a helix, the improvement comprising drive means for said rollers, clutch means operatively interposed between said drive means and at least one of said rollers, and brake means operatively interposed between at least one of said rollers and said frame structure, and further comprising means for securing said strip steel knife means to said cutting roller, said strip steel knife means having flat backs resting on said outer surface of said cutting roller, said securing means comprising blocks, means affixing said blocks to said cutting roller and means securing said strip steel knife means to said blocks, said blocks having a T-configuration including a support member and a cross-member connected to each other, said securing means connecting said strip steel knife means to said cross member, said affixing means comprising holes in the surface of the cutting roller, each support member extending into a respective hole, and means for clamping said support member in its hole.

15. The apparatus according to claim 14, wherein said cross member comprises a longitudinal gap for receiving the strip steel knife means, said gap being deep enough so that said flat backs of the strip steel knife means rest on the cutting roller surface, said cross member further comprising a threaded bore extending toward said gap, and screw means extending into said threaded bore to hold the strip steel knife means in said gap, said cross member further including a first hole extending down into said support member, the support member comprising second conical hole axially aligned with said first hole in the cross member, a shoulder between said first and second holes, a screw having a head resting on said shoulder and a threaded end reaching into said second, conical hole, a wedging body in said second, conical hole, said wedging body having a threaded hole in which said threaded screw end is received for expanding the support member against the cutting roller.

16. The apparatus according to claim 15, wherein said threaded hole extends through said cross member, said strip steel knife means comprising aperture means registering with the respective threaded hole, said screw means extending through said aperture means.

17. In an apparatus for cutting sheet material advancing in a given direction, including a frame structure, a cutting roller for cutting the sheet material substantially across said advancing direction and a counter pressure roller, each roller having a rotational axis and an outer surface, means rotatably supporting both of said rollers in said frame structure for cooperation with each other, strip steel knife means, means securing said strip steel knife means to said cutting roller, whereby said strip steel knife means extend substantially radially away from said cutting roller, said strip steel knife means following a helix around the cutting roller which extends with its longitudinal axis at an angle ($\alpha$) relative to a line extending perpendicularly to said given direction, said angle ($\alpha$) compensating for the fact that the strip steel knife means follow a helix, the improvement comprising drive means for said rollers, clutch means operatively interposed between said drive means and at least one of said rollers, and brake means operatively interposed between at least one of said rollers and said frame structure, and further comprising curved support elements for said strip steel knife means, and means securing said curved support elements to the surface of said cutting roller, said curved support elements havng free edges extending circumferentially relative to said cutting roller surface, said securing means comprising clamping members overlapping said free edges, and means affixing said clamping members to said cutting roller.

18. The apparatus according to claim 17, wherein said overlapping clamping members permit the axial adjustment of the curved support members and thus of the strip steel knife means along the length of the cutting roller.

19. The apparatus according to claim 17, wherein the affixing means comprise screws and screw holes arranged in the cutting roller along helical lines.

20. In an apparatus for cutting sheet material advancing in a given direction, including a frame structure, a cutting roller for cutting the sheet material substantially across said advancing direction and a counter pressure roller, each roller having a rotational axis and an outer surface, means rotatably supporting both of said rollers in said frame structure for cooperation with each other, strip steel knife means, means securing said strip steel knife means to said cutting roller, whereby said strip steel knife means extend substantially radially away from said cutting roller, said strip steel knife means following a helix around the cutting roller which extends with its longitudinal axis at an angle ($\alpha$) relative to a line extending perpendicularly to said given direction, said angle ($\alpha$) compensating for the fact that the strip steel knife means follow a helix, the improvement comprising drive means for said rollers, clutch means operatively interposed between said drive means and at least one of said rollers, and brake means operatively interposed between at least one of said rollers and said frame structure, said drive means for said rollers comprising a motor, gear means driven by said motor and a chain drive provided in common for both of said rollers, said chain drive positively interconnecting said rollers with said motor to said gear means.

21. In an apparatus for cutting sheet material advancing in a given direction, including a frame structure, a cutting roller for cutting the sheet material substantially across said advancing direction and a counter pressure roller, each roller having a rotational axis and an outer surface, means rotatably supporting both of said rollers in said frame structure for cooperation with each other, strip steel knife means, means securing said strip steel knife means to said cutting roller, whereby said strip steel knife means extend substantially radially away from said cutting roller, the improvement wherein said securing means comprise a plurality of holes extending radially through the outer circumference of said cutting roller, each of said means securing said strip steel knife means further comprising a separate holding block, each having a rotational axis, releasably held in each of a plurality of said holes, said holding blocks having projections fitting into said holes and means securing said projections in said holes, each holding block being rotatable in its released condition, said holding blocks being spaced apart axially of said cutting roller, and means for releasably holding said strip steel knife means in each of said holding blocks, said strip steel knife means defining a plane which coincides with the rotational axes of all of its holding blocks.

22. The apparatus of claim 21, wherein each of said holding blocks has a slit extending radially of said cutting roller, said strip steel knife means being inserted in the slit of each of said holding blocks and having a flat back engaging the outer circumference of said cutting roller.

23. The apparatus of claim 22, wherein said strip steel knife means has aperture means extending therethrough at each of said holding blocks, and said means releasably holding said strip steel knife means to said holding blocks comprise screws extending through said apertures and at least partially through said holding blocks.

24. The apparatus of claim 22, wherein said strip steel knife means are provided with apertures (72) opening toward said flat back at each said holding block, said means releasably holding said srip steel knife means to said holding blocks comprising screw means extending completely through said holding blocks and through said apertures in said strip steel knife means.

25. The apparatus of claim 21, wherein said securing means comprise means for wedging said projections in said holes.

* * * * *